US009445671B2

(12) United States Patent
Ng

(10) Patent No.: US 9,445,671 B2
(45) Date of Patent: Sep. 20, 2016

(54) LOCKING REGULATION DEVICE FOR DRAWER SLIDE RAIL

(71) Applicant: GUANGDONG TAIMING METAL PRODUCTS CO. LTD, Foshan (CN)

(72) Inventor: Tai Wai Ng, Foshan (CN)

(73) Assignee: Guangdong Taiming Metal Products Co., Ltd., Foshan (CN)

( * ) Notice: Subject to any disclaimer, the term of this patent is extended or adjusted under 35 U.S.C. 154(b) by 0 days.

(21) Appl. No.: 14/681,622

(22) Filed: Apr. 8, 2015

(65) Prior Publication Data

US 2016/0128476 A1 May 12, 2016

(30) Foreign Application Priority Data

Nov. 10, 2014 (CN) ..... 2014 2 0670941 U

(51) Int. Cl.
*A47B 88/16* (2006.01)
*A47B 88/04* (2006.01)
(Continued)

(52) U.S. Cl.
CPC ..... *A47B 88/16* (2013.01); *A47B 88/04* (2013.01); *E05B 65/46* (2013.01); *E05C 3/165* (2013.01); *E05C 3/22* (2013.01)

(58) Field of Classification Search
CPC ..... A47B 88/0085; A47B 2088/0088; A47B 2088/0092; A47B 88/0418; A47B 88/0422; A47B 2088/0425; A47B 2088/0429; A47B 2088/0433; A47B 2088/0437; A47B 2210/0051; A47B 2210/0054; A47B 2210/09; A47B 2210/091
See application file for complete search history.

(56) References Cited

U.S. PATENT DOCUMENTS 8,854,769 B1 * 10/2014 Liang ..... A47B 88/0422 360/125.51
2008/0000052 A1 * 1/2008 Hong et al. ..... 16/382
(Continued)

FOREIGN PATENT DOCUMENTS

CN 2912359 Y * 6/2007 ..... A47B 88/04
CN 101543344 A * 9/2009 ..... A47B 88/04
(Continued)

*Primary Examiner* — Andrew Roersma
(74) *Attorney, Agent, or Firm* — Maier & Maier, PLLC

(57) ABSTRACT

A locking regulating device for drawer slide rail, comprising a slide rail component and a drawer, wherein the drawer is fixedly connected with the movable rail on the slide rail component, characterized in that, a locking regulating device fixed on the drawer is also included, the drawer is designed to latch the square hole on the movable rail through the locking regulating device to realize mutual connection; the locking regulating device comprises a locking mechanism and a regulating mechanism; the locking mechanism is composed of a handle and a lock catch through mutual transmission; through the lock catch, the regulating device is self-locked on the movable rail and acts on the handle to complete unlocking of the lock catch; the regulating mechanism is designed to respectively make three-dimensional regulation to the drawer from up/down, left/right and front/back directions. The present utility model realizes locking and three-dimensional regulation through the locking mechanism and the regulating mechanism. The locking mechanism is designed to realize self-locking by locking the movable rail through lock catch and perform unlocking through handle transmission to lock catch, so as to conveniently realize the unlocking and separation between drawer and movable rail. The regulating mechanism is designed to respectively make regulation to the drawer in the up/down, left/right and front/back direction, thus contributes to the coordination between drawer and movable rail and meets the demand of different consumers.

7 Claims, 6 Drawing Sheets

(51) Int. Cl.

| | |
|---|---|
| ***E05C 3/22*** | (2006.01) |
| ***E05C 3/16*** | (2006.01) |
| ***E05B 65/46*** | (2006.01) |

(56) References Cited

U.S. PATENT DOCUMENTS

| | | | | |
|---|---|---|---|---|
| 2011/0068670 | A1* | 3/2011 | Ritter | 312/334.1 |
| 2012/0311818 | A1* | 12/2012 | Grabher | 16/82 |
| 2013/0113356 | A1* | 5/2013 | Salice | 312/334.44 |
| 2013/0293077 | A1* | 11/2013 | Haemmerle et al. | 312/319.1 |
| 2014/0185968 | A1* | 7/2014 | Langguth | 384/22 |

FOREIGN PATENT DOCUMENTS

| | | | | | |
|---|---|---|---|---|---|
| CN | 101664249 | A | * | 3/2010 | A47B 88/04 |
| CN | 102326978 | A | * | 1/2012 | A47B 88/04 |
| CN | 202919551 | U | * | 5/2013 | A47B 88/04 |
| CN | 203399851 | U | * | 1/2014 | A47B 88/04 |
| CN | 203692956 | U | * | 7/2014 | A47B 88/04 |
| CN | 203692957 | U | * | 7/2014 | A47B 88/04 |
| DE | 202012012265 | U1 | * | 3/2014 | A47B 88/04 |
| WO | WO2013034494 | A1 | * | 3/2013 | A47B 88/04 |

* cited by examiner

LOCKING REGULATION DEVICE FOR DRAWER SLIDE RAIL

FIELD OF THE INVENTION

The present utility model relates to a locking device for drawer and slide rail, in particular to a locking regulating device for drawer and slide rail.

BACKGROUND OF THE PRIOR ART

On Apr. 10, 2013, Chinese patent document (CN 102326978 B) discloses a locking regulating mechanism for drawer slide rail, comprising a coupling base for drawer bottom surface, a locking lever is rotationally connected on the connecting base, a latch bolt in buckled connection with slide rail is provided on one end of the locking bar, another end of locking bar extents out of the handle, the latch bolt is disengaged from the slid rail by pressing the handle. An inclined guidance plane is provided on the slide rail corresponding to the latch bolt, a stepped type locking part is provided at the back of the guidance plane, the stepped type locking part is in buckled connection with the locking hole provided on the slide rail, the quantity of steps of the stepped type locking part is more than two. The locking rod is provided on the pillar of the coupling base through the locating hole on its central part, a fixed part is provided between the locating hole and the brace, and an elastic element is provided on the pillar. Since this structure is only provided with high-low regulating mechanism and thus is far from being able to meet the user needs. Therefore, it is necessary to make further improvement.

SUMMARY OF UTILITY MODEL

It is the objective of the present utility model to provide a locking regulating device for drawer slide rail, which is featured by simple and reasonable structure, simple assembly, reliable performance, extensive application, convenient disassembly and assembly, three-dimensional regulation function and high market adaptability, so as to overcome the deficiency in the prior art.

A locking regulating device for drawer slide rail designed according to this objective, comprising a slide rail component and a drawer, wherein the drawer is fixedly connected with the movable rail on the slide rail component, characterized in that, a locking regulating device fixed on the drawer is also included, the drawer is designed to lock the square hole on the movable rail through the locking regulating device, so as to realize mutual connection; the locking regulating device comprises a locking mechanism and a regulating mechanism; the locking mechanism is composed of a handle and a lock catch through mutual transmission; through the lock catch, the locking regulating device is self-locked on the movable rail and acts on the handle to complete unlocking of lock catch; the regulating mechanism is designed to respectively make three-dimensional regulation to the drawer in up/down, left/right and front/back directions.

The locking regulating device is composed of a base panel and left/right regulating plates which are assembled in up/down directions; the base panel is fixed on the drawer's base panel, left/right regulating plates are locked with or separated from the movable rail; the left/right regulating plates have certain movement space between the base panel and the drawer's base panel.

The handle and the lock catch are respectively rotationally connected on the left/right regulating plates; one end of the handle and the lock catch are locally provided with matching teeth and mutually tooth connected.

The non-tooth end of handle and the non-tooth end of the lock catch are respectively exposed; the exposed part of the handle is a bar-type grip, a plurality of lock catch teeth are provided in ladder pattern on the exposed part of the lock catch; all the lock catch teeth can be inserted into the square hole on the movable rail to complete self-locking; locating pieces with guide surfaces are provided on the left/right regulating plates; in the process of self-locking, the locating pieces are inserted into the movable rail to realize the fixed positioning of the left/right regulating plates and the movable rail in the left/right directions.

An elastic element is provided in the locking regulating device, the acting force of the elastic element is respectively loaded on the left/right regulating plates and the handle, so that the handle and the lock catch perform elastic resetting and rotation, in idle state the handle and the lock catch are under locked state.

The regulating mechanism in the locking regulating device comprises an up/down regulating mechanism, a left/right regulating mechanism and a front/back regulating mechanism.

The up/down regulating mechanism comprises an up/down regulating knob and an up/down regulating piece which are designed to realize transmission through teeth; a strip hole with an acting part being exposed on the base panel is provided on the up/down regulating knob; downward strip teeth are provided on the inner arm of the strip hole, at least a tooth tip is correspondingly provided on the up/down regulating knob; an inclined plane is provided on one end part of the up/down regulating piece and is inserted between the movable rail and the drawer; the up/down regulating knob is rotated to control the insertion and/or pull-out distance of the up/down regulating piece to realize the up/down regulation of drawer.

The left/right regulating mechanism comprises a regulating nut and a left/right regulating plate which are in mutual bolted connection; a regulating lever with thread is provided on the left/right regulating plate, and the regulating nut is in bolted connection with it and is exposed to the left/right regulating hole correspondingly provided on the base panel; the left/right regulating hole has the positioning function on the regulating nut, and the regulating nut is rotated to realize the left/right regulation of drawer.

The front/back regulating mechanism comprises a front/back regulating base, a regulating nut and a front/back regulating plate; wherein the front/back regulating base is fixed on the base panel, and a regulating column with thread is provided on the front/back regulating plate; the regulating column passes through the front/back regulating base and is in bolted connection with the regulating nut; a regulating plane which abuts on one end of the fixed rail is provided on the front/back regulating plate, and the regulating nut is rotated to realize the front/back regulation of drawer.

The locking regulating device is assembled on the drawer's base panel in left/right symmetric manner and synchronously completes the self-locking and/or unlocking separation with the movable rail.

The present utility model is provided to realize locking and three-dimensional regulation of drawer and movable rail through locking mechanism and regulating mechanism; wherein the locking mechanism enables the locking regulating device and the movable rail to realize self-locking through lock catch, so that it is feasible to complete the installation of drawer in rapid and simple manner; a handle transmission lock catch is provided to realize unlocking and help the unlocking and separation of drawer and movable rail in rapid manner; the regulating mechanism can respectively make up/down, left/right and front/back regulation to the relative position between drawer and movable rail, make regulation to the position of drawer, contribute to the coordination between drawer and movable rail, facilitate the user to complete the opening/closing action of drawer and thus comprehensively meet the needs of different users. The present utility model is featured by simple and reasonable structure, simple assembly, reliable performance, extensive application, convenient disassembly and assembly, three-dimensional regulation function and high market adaptability.

DESCRIPTION OF ATTACHED DRAWINGS

DETAILED DESCRIPTION OF PREFERRED EMBODIMENTS

Further detailed description of the present utility model is provided with reference to specific embodiments in combination with attached drawings.

As shown in FIGS. 1-5, The locking regulating device for drawer slide rail, comprising a slide rail component and a drawer, wherein slide rail component is composed of a fixed rail fixed on the cabinet body and a movable rail 13 provide above the fixed rail, and the drawer is fixedly connected with the movable rail 13; a locking regulating device fixed on the drawer is also included, the drawer is designed to lock the square hole on the movable rail (13) through the locking regulating device, so as to realize mutual connection; a locking mechanism and a regulating mechanism are included in the locking regulating device; the locking mechanism is composed of a handle 7 and a lock catch 8 through mutual transmission; through the lock catch 8, the locking regulating device is self-locked on the movable rail and acts on the handle 7 to complete the unlocking of lock catch 8; the drawer can be separated from the movable rail; the regulating mechanism is designed to respectively make three-dimensional regulation to the drawer in up/down, left/right and front/back directions.

Figure 1:
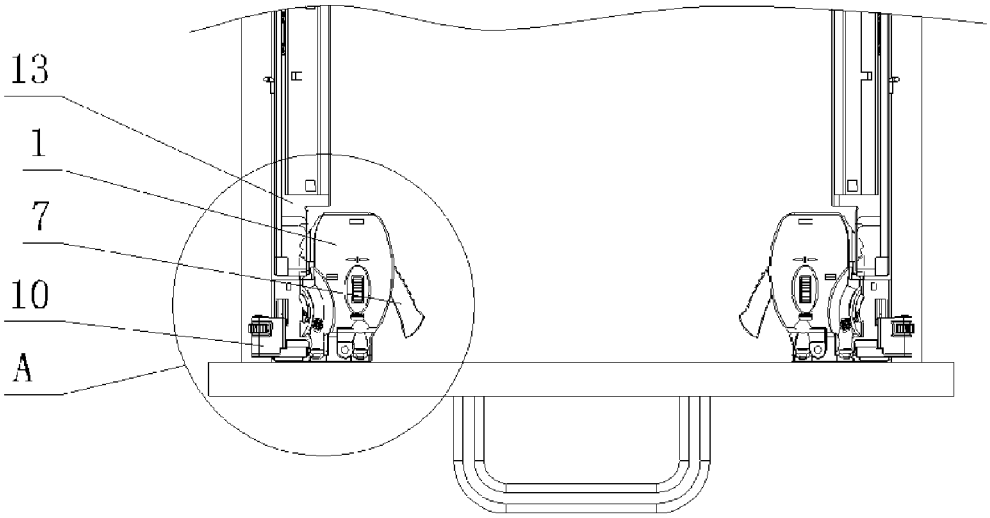
FIG. 1 illustrates the use state of the present utility model.
Figure 2:
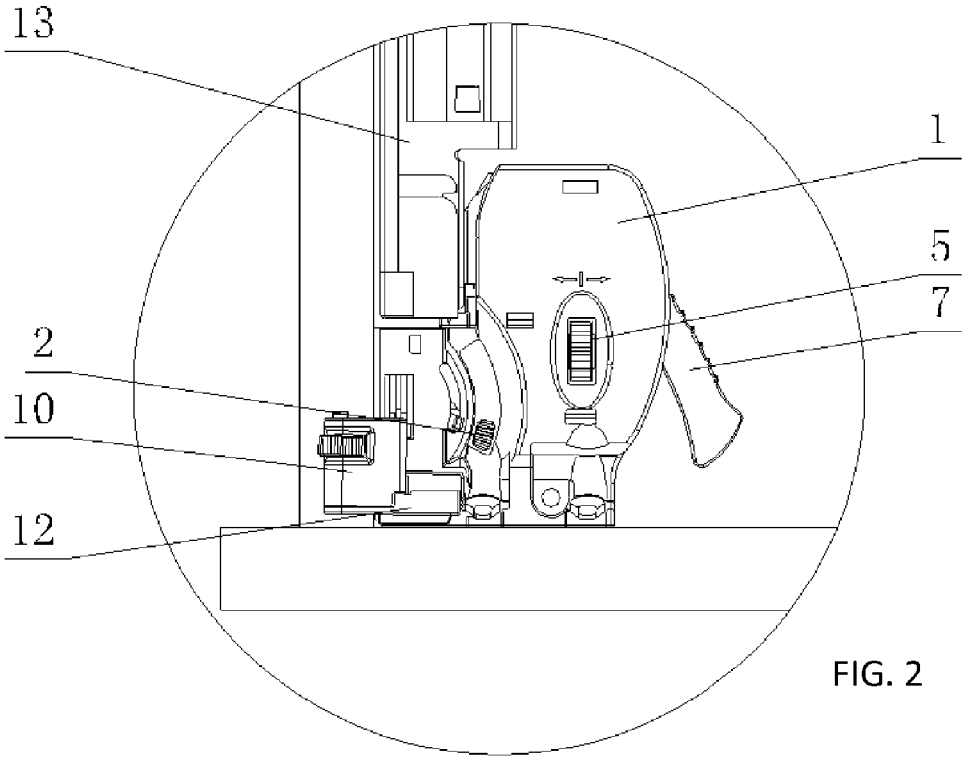
FIG. 2 is the enlarged structure diagram of A position in FIG. 1.
Figure 3:
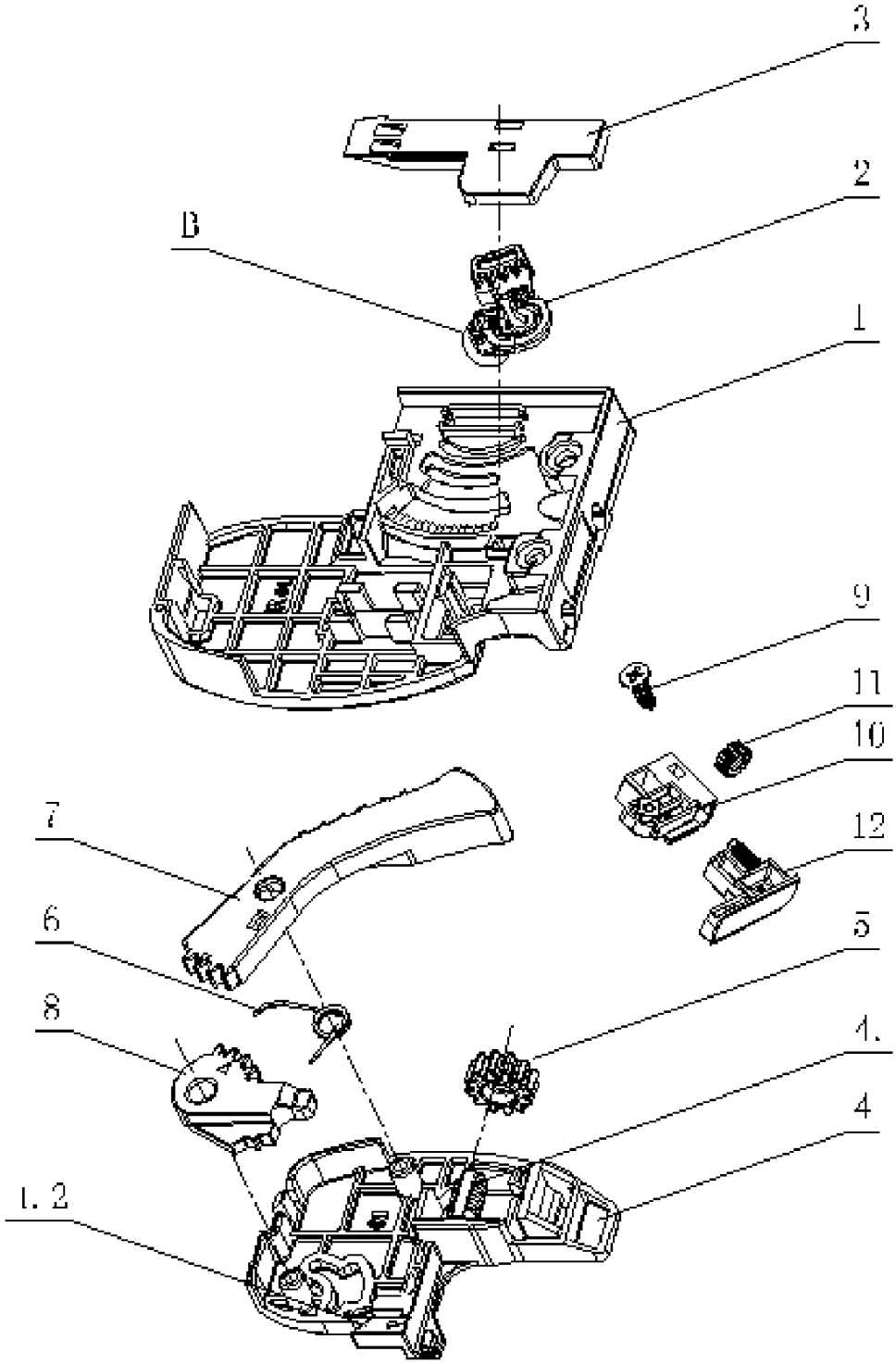
FIG. 3 is the exploded view of the present utility model.
Figure 4:
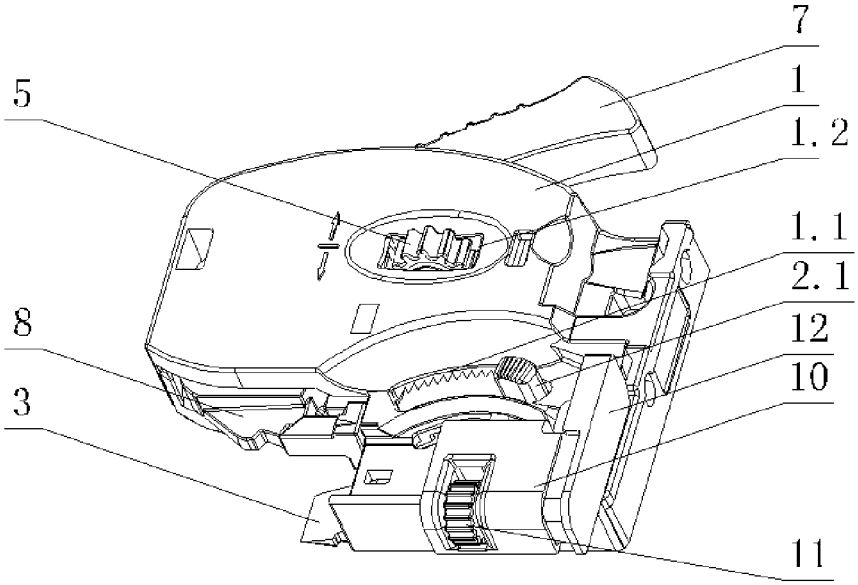
FIG. 4 is the schematic diagram of the assembly structure of the present utility model.

Specifically, with reference to FIGS. 3-4, the locking regulating device is composed of a base panel 1 and left/right regulating plates which are assembled in up/down directions; the base panel 1 is fixed on the drawer's base panel, the left/right regulating plates are locked with or separated from the movable rail; the left/right regulating plates 4 have certain movement space between the base panel and the drawer's base panel to realize left/right regulation.

Figure 5:
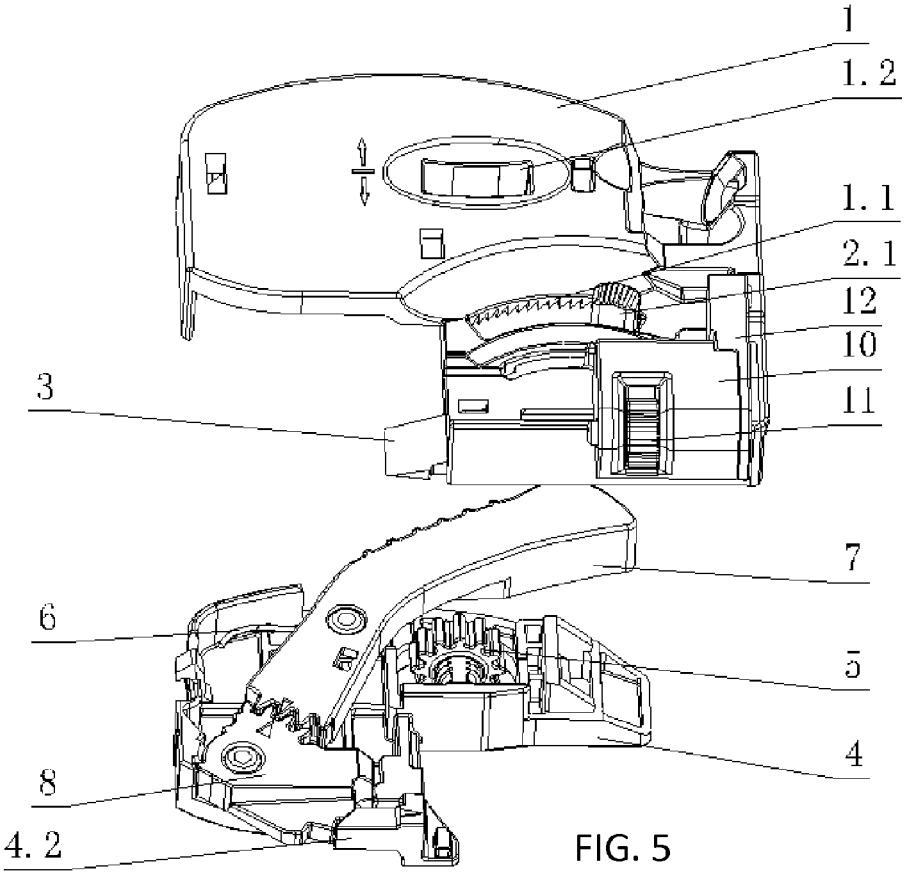
FIG. 5 is the local breakdown structure diagram of the present utility model.

As shown in FIG. 5, the handle 7 and the lock catch 8 are respectively rotationally connected on the left/right regulating plates 4; one end of the handle 7 and the lock catch 8 are locally provided with matching teeth and mutually tooth connected, they mutually generate acting force and control each other through transmission; the non-tooth end of the handle 7 and the non-tooth end of the lock catch (8) are respectively exposed; the exposed part of the handle (7) is a bar-type grip provided for the user to operate; three layers of lock catch teeth 8.1 are provided in ladder pattern on the exposed part of the lock catch 8; all the lock catch teeth 8.1 can be progressively inserted into the square holes on the movable rail 13 to complete self-locking; locating pieces 4.2 with guide surfaces are provided on the left/right regulating plates 4; the locating pieces 4.2 are inserted into the movable rail 13 to realize the fixed positioning of the left/right regulating plates 4 and the movable rail 13 in the left/right directions.

An elastic element 6 is provided in the locking regulating device, wherein the elastic element 6 is a torsion spring which is coaxially assembled with the connection point of handle 7, the acting force of the elastic element 6 is respectively loaded on the left/right regulating plates 4 and the handle 7, so that the handle 7 and the lock catch 8 perform elastic resetting and rotation, in idle state the handle 7 and the lock catch (8) are under locked state, namely the lock catch teeth 8.1 are exposed, the handle 7 is lifted, and elastic positioning is realized through the positioning part 8.2 on the lock catch 8.

Figure 6:
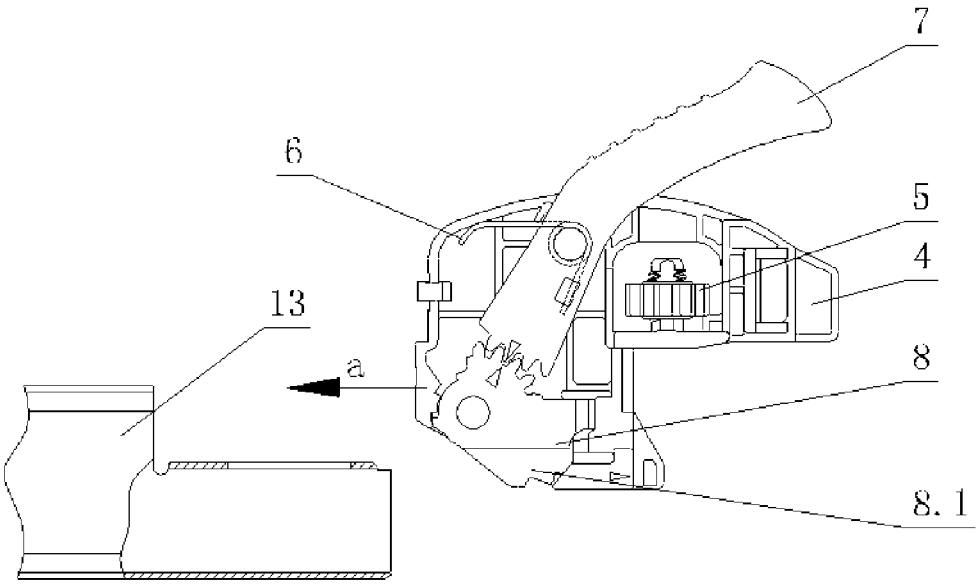
FIG. 6 is the schematic diagram when the locking regulating device is prepared to lock the movable rail in the present utility model.
Figure 7:
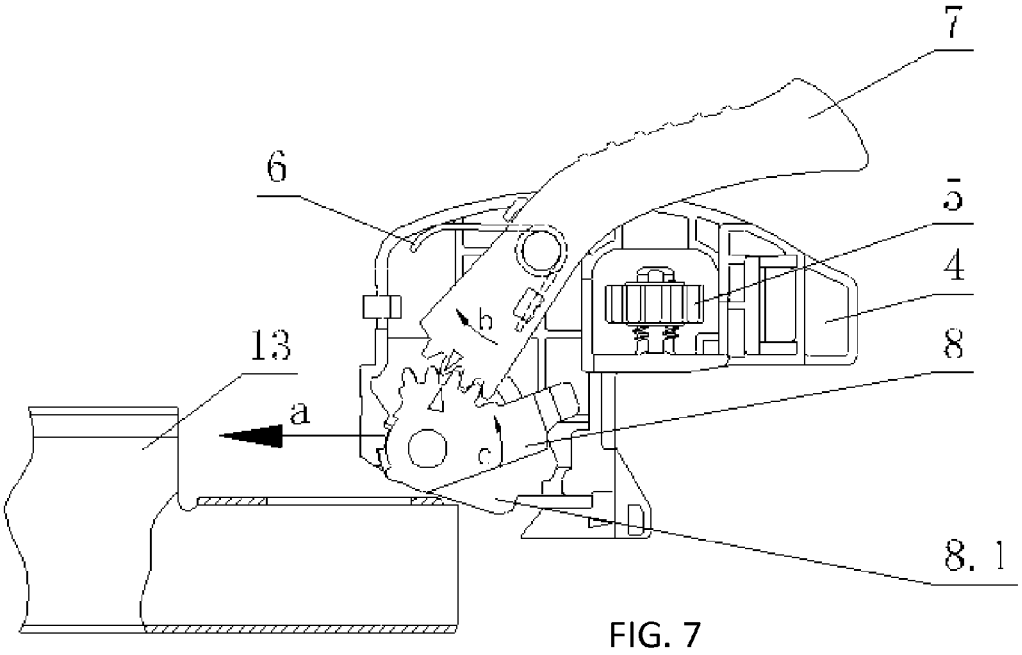
FIG. 7 is the schematic diagram that the in the process of locking of the locking regulating device and the movable rail in the present utility model, the movable rail presses against the first lock catch tooth.
Figure 8:
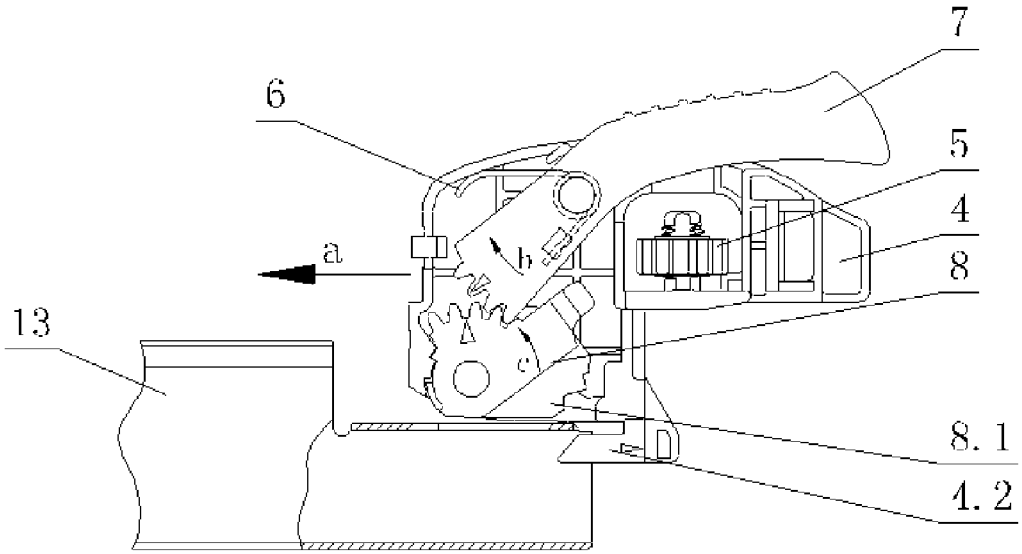
FIG. 8 is the schematic diagram that in the process of locking of the locking regulating device and the movable rail in the present utility model, the locating piece is inserted into the lock catch tooth.
Figure 9:
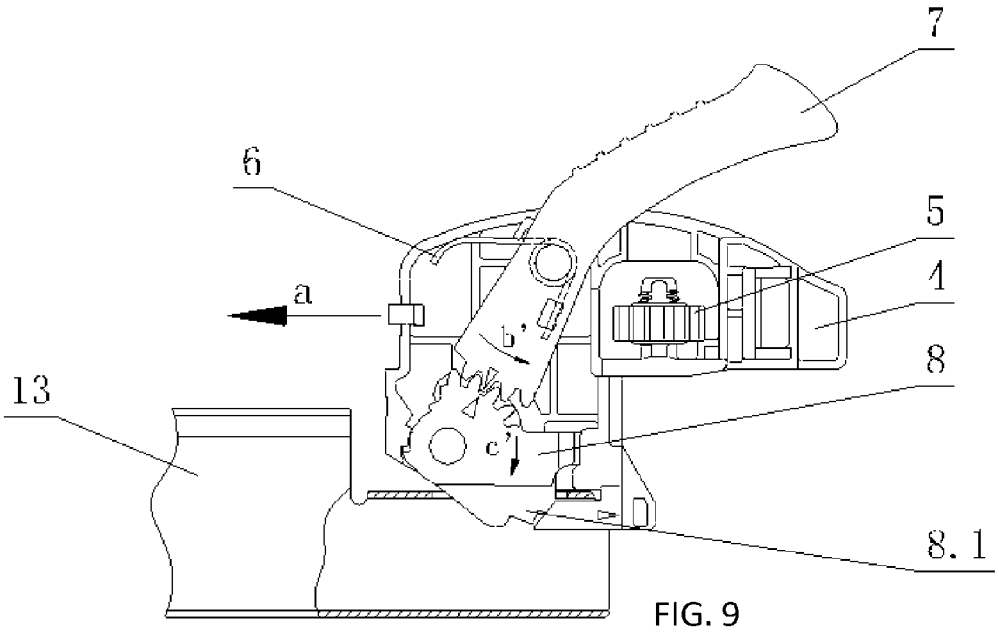
FIG. 9 is the structural diagram when the locking regulating device and movable rail in the present utility model complete locking.
Figure 10:
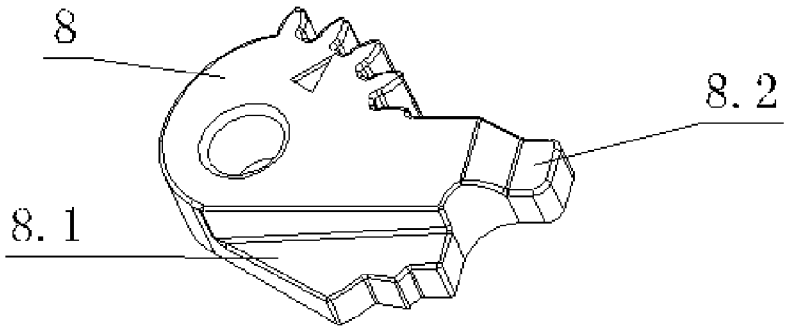
FIG. 10 is the three-dimensional structure diagram of the lock catch in the present utility model.
Figure 11:
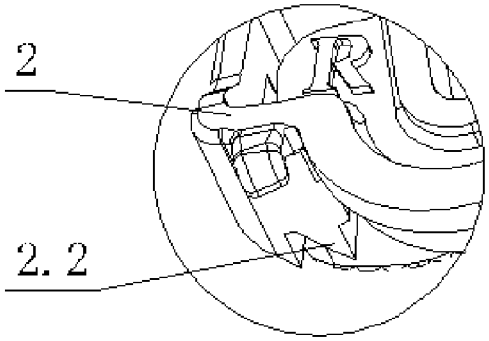
FIG. 11 is the enlarged structure diagram of B position in FIG. 3.
Figure 12:
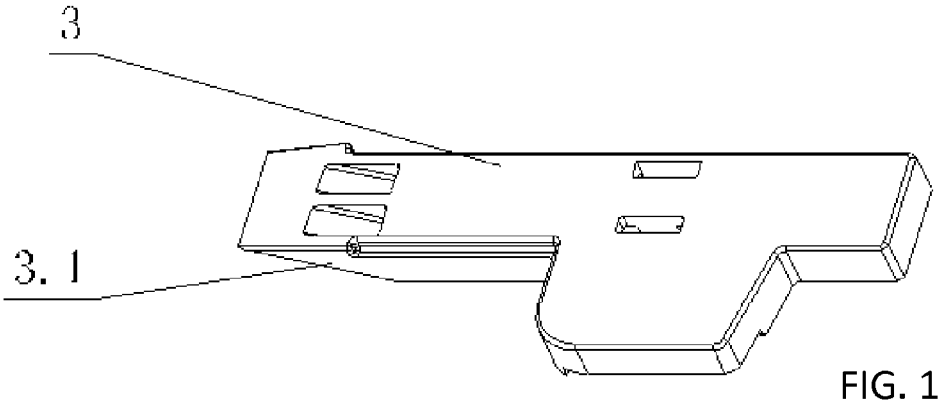
FIG. 12 is the three-dimensional structure diagram of up/down regulating piece of the present utility model.
Figure 13:
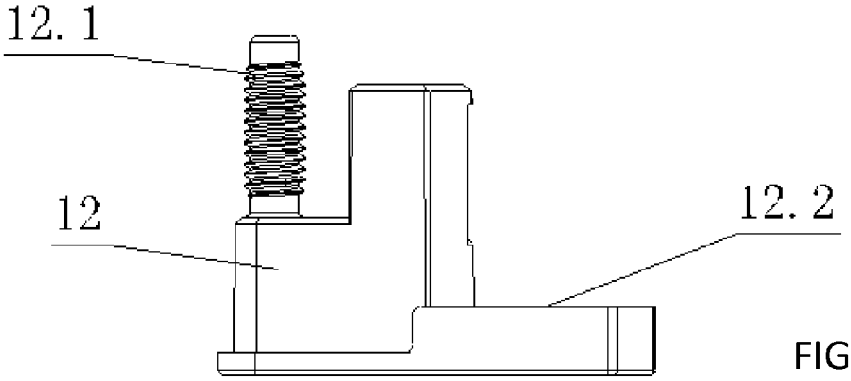
FIG. 13 is the three-dimensional structure diagram of the front/back regulating plate of the present utility model.

As shown in FIG. 6, when the drawer is connected with the movable rail 13, the movable rail 13 corresponding to the locking regulating device moves towards a direction and starts self-locking connection; at this moment, the locking regulating device is in locked state, namely the lock catch teeth 8.1 are exposed, while the handle 7 is lifted. As shown in FIG. 8, when the end part of the movable rail 13 starts to contact the first lock catch tooth 8.1, the locking regulating device continues to move towards a direction, then the movable rail 13 acts on the first locking opening 8.1, the lock catch 8 is acted to rotate towards c direction; through transmission, it acts on the handle 7 to rotate towards b direction; due to lever action, the exposed part of handle 7 is withdrawn. As shown in FIG. 8, the locking regulating device continues to move towards a direction, the end part of movable rail 13 continues to act on the first lock catch teeth 8.1, the lock catch 8 and the handle 7 continue to rotate along the directions c and b, until the first lock catch teeth 8.1 completely enter the locking regulating device, then the first lock catch teeth 8.1 elastically press against the end part of the movable rail 13, and the lock catch 8 and the handle 8 stop rotation; at the same time, the locating piece 4.2 is inserted into the movable rail 13. As shown in FIG. 9, the locking regulating device continues to move towards a direction; when the first lock catch teeth 8.1 meet the square hole, the locking regulating device will be locally ejected and enter into the square hole; when the locking regulating device continues movement, the second and the third lock catch teeth 8.1 enter into the square hole in turn, the locking regulating device recovers locking state to complete self-locking and realize locking of movable rail 13; at the same time, the locating piece 4.2 is completely inserted into the movable rail 13 to realize its fixation with the movable rail 13 in the left/right directions.

When unlocking is needed, the exposed grip acting on the handle 7 is partially withdrawn; through transmission, all the lock catch teeth 8.1 on the lock catch 8 leave the square hole and enter the locking regulating device, extract the drawer towards the reverse direction of a, complete the unlocking separation from the movable rail 13. The operation is convenient and simple.

The regulating mechanism in the locking regulating device comprises an up/down regulating mechanism, a left/right regulating mechanism and a front/back regulating mechanism.

The up/down regulating mechanism comprises an up/down regulating knob 2 and an up/down regulating piece 3 which are designed to realize transmission through teeth; a strip hole 1.1 with an acting part 2.1 being exposed on the base panel 1 is provided on the up/down regulating knob; downward strip teeth are provided on the inner arm of the strip hole 1.1, at least a tooth tip 2.2 is correspondingly provided on the up/down regulating knob 2; when the up/down regulating knob 2 is operated, it is necessary to press down the acting part 2.1, so that operation can be realized and completed when the tooth tip 2.2 is disengaged from the strip teeth; when the user gives up pressing on the acting part 2.1, the acting part 2.1 springs back, the tooth tip 2.2 falls into the strip tooth and plays the fixing action; the up/down regulating piece 3 is in strip block form, an inclined plane 3.1 is provided on one end part of the up/down regulating piece 3 and is inserted between the movable rail 13 and the drawer; the regulating knob 2 is operated to control the insertion and/or pull-out distance of the up/down regulating piece 3 to realize the up/down regulation of drawer.

The left/right regulating mechanism comprises a regulating nut 5 and a left/right regulating plate (4) which are in mutual bolted connection; a regulating lever (4.1) with thread is provided on the left/right regulating plate 4, and the regulating nut 5 is in bolted connection with it and is exposed to the left/right regulating hole 1.2 which are correspondingly provided on the base panel 1; the left/right regulating hole (1.2) has the positioning function on the regulating nut 5; in addition, since the left/right regulating plate 4 and the movable rail 13 are fixed in left/right directions, when the left/right regulating plate 4 and the movable rail 13 are standing while the regulating nut 5 is rotated, the drawer can make relative left/right movement, and the left/right regulation of drawer can be realized.

The front/back regulating mechanism comprises a front/back regulating base 10, a regulating nut 11 and a front/back regulating plate 12; wherein the front/back regulating base is fixed on the base panel 1, and a regulating column 12.1 with thread is provided on the front/back regulating plate 12; the regulating column passes through the front/back regulating base 10 and then is in bolted connection with the regulating nut 11; a regulating plane 12.2 which abuts on one end of the fixed rail is provided on the front/back regulating plate 12, and the regulating nut 11 is rotated to realize the front/back regulation of drawer.

The locking regulating device is assembled on the drawer's base panel in left/right symmetric manner and synchronously completes the self-locking and/or unlocking separation with the movable rail 13.

The preferred embodiments of the present utility model are described above. All the simple modifications or transformations made by those skilled in the art to these embodiments fall within the claims of the present utility model.

The invention claimed is:

1. A locking regulating device for drawer slide rail, comprising:

a slide rail component and a drawer, wherein the drawer is fixedly connected with a movable rail of the slide rail component; the locking regulating device is fixed on the drawer, the drawer locks to a square hole on the movable rail through the locking regulating device, so as to realize mutual connection between the drawer and the movable rail; the locking regulating device comprises a locking mechanism and a regulating mechanism;

the locking mechanism comprises a handle and a lock catch engaged together; the locking regulating device is self-locked on the movable rail by the lock catch, and the handle is activated to complete unlocking of the lock catch from the movable rail;

the regulating mechanism is configured to respectively make three-dimensional regulation to the drawer in up and down, left and right, and front and back directions; the regulating mechanism comprises a first base panel and a left and right regulating plate, the first base panel and the left and right regulating plate are assembled in the up and down directions; the first base panel is fixed on a base panel of the drawer, the left and right regulating plates is locked with or separated from the movable rail; the left and right regulating plate is in as certain movement space between the first base panel and the base panel of the drawer;

wherein the handle and the lock catch are respectively rotationally connected to the left and right regulating plate; one end of the handle and one end of the lock catch are locally provided with matching pluralities of gear teeth, the handle and the lock catch are mutually tooth connected at the gear teeth, such that rotary motion of the handle induces rotary motion of the lock catch; and wherein an end of handle opposite the gear teeth and an end of the lock catch opposite the gear teeth are respectively exposed; the end of the handle opposite the gear teeth is a bar grip, the bar grip protruding outward from the looking regulating device at a first angle and curving inwardly; a plurality of lock catch teeth are provided in a ladder pattern on the end of the lock catch opposite the gear teeth; all the lock catch teeth can be inserted into the square hole on the movable rail to complete self-locking; locating pieces with guide surfaces are provided on the left and right regulating plate; the locating pieces are inserted into the movable rail to realize fixed positioning of the left and right regulating plate and the movable rail in the left and right directions.

2. The locking regulating device of drawer slide rail of claim 1, wherein an elastic element is comprised in the locking regulating device, an acting force of the elastic element is respectively loaded on the left and right regulating plate and the handle, so that the handle and the lock catch perform elastic resetting and rotation, in an idle state the handle and the lock catch are under a locked state.

3. The locking regulating device for drawer slide rail of claim 1, wherein the regulating mechanism of the locking regulating device comprises an up and down regulating mechanism, a left and right regulating mechanism, and a front and back regulating mechanism.

4. The locking regulating device for drawer slide rail of claim 3, wherein the up and down regulating mechanism comprises an up and down regulating knob and an up and down regulating piece which are configured to realize transmission through teeth; a strip hole is provided on the up and down regulating knob, with an acting part being exposed through the first base panel; downward strip teeth are provided on an the inner arm of the strip hole, at least a tooth tip is correspondingly provided on the up and down regulating knob; an inclined plane is provided on one end part of the up and down regulating piece and is inserted between the movable rail and the drawer; the regulating knob is operated to control at least one of insertion distance and/or pull-out distance of the up and down regulating piece to realize up and down regulation of drawer.

5. The locking regulating device for drawer slide rail of claim 3, wherein the left and right regulating mechanism comprises a regulating nut and the left and right regulating plate which are in mutual bolted connection; a regulating lever with thread is provided on the left and right regulating plate, and the regulating nut is in bolted connection with the thread on the left and right regulating plate, and the regulating nut is exposed through a left and right regulating hole correspondingly provided on the first base panel; the left and right regulating hole has a positioning function on the regulating nut, and the regulating nut is rotated to realize left and right regulation of drawer.

6. The locking regulating device for drawer slide rail of claim 3, wherein the front and back regulating mechanism comprises a front and back regulating base, a regulating nut, and a front and back regulating plate; wherein the front and back regulating base is fixed on the first base panel, and a regulating column with thread is provided on the front and back regulating plate, wherein the regulating column extends parallel to an aligner portion of the front and back regulating plate; the regulating column passes through the front and back regulating base and is in bolted connection with the regulating nut; a regulating plane which abuts on one end of a fixed rail is provided on the front and back regulating plate, and the regulating nut is rotated to realize front and back regulation of drawer.

7. The locking regulating device for drawer slide rail disclosed in claim 1, wherein the locking regulating device is assembled on the base panel of the drawer in left and right symmetric manner and completes self-locking and/or unlocking separation with the movable rail in a synchronization mode.

* * * * *